United States Patent [19]

Prezioso

[11] 4,013,311

[45] Mar. 22, 1977

[54] HIGH SECURITY DOOR LOCK

[76] Inventor: Richard L. Prezioso, 2050 Barnum Ave., Stratford, Conn. 06497

[22] Filed: Apr. 6, 1976

[21] Appl. No.: 674,225

[52] U.S. Cl. ..... 292/59; 70/417; 292/62; 292/264; 292/302; 292/327

[51] Int. Cl.[2] ..... E05C 5/02

[58] Field of Search ..... 292/302, 259, 146, 341.15, 292/327, DIG. 32, 62, 59, 264, 60; 70/417

[56] References Cited

UNITED STATES PATENTS

| | | | |
|---|---|---|---|
| 1,311,500 | 7/1919 | Dresser | 292/327 |
| 1,351,117 | 8/1920 | Newhall | 292/302 |
| 2,276,915 | 3/1942 | Axe et al. | 292/60 |
| 3,591,219 | 7/1971 | Graziosi | 292/341.15 |

*Primary Examiner*—Paul R. Gilliam

*Assistant Examiner*—Kenneth J. Dorner

*Attorney, Agent, or Firm*—Bryan & Bollo

[57] ABSTRACT

A high security door lock having a crossbar mounted on a door and a keeper mounted on the door frame. A pin with at least one projection is provided to secure the crossbar to the keeper by inserting the pin through at least one slot in the keeper. A locking channel is provided integral with the keeper and located at an angle to the slot in the keeper. When the pin is inserted into the keeper and rotated, the pin projection seats in the locking channel. A biasing means is provided to coact with the pin to hold the projection in the locking channel and prevent uncoupling of the crossbar from the keeper absent depression and rotation of the pin.

19 Claims, 3 Drawing Figures

Fig. 1.
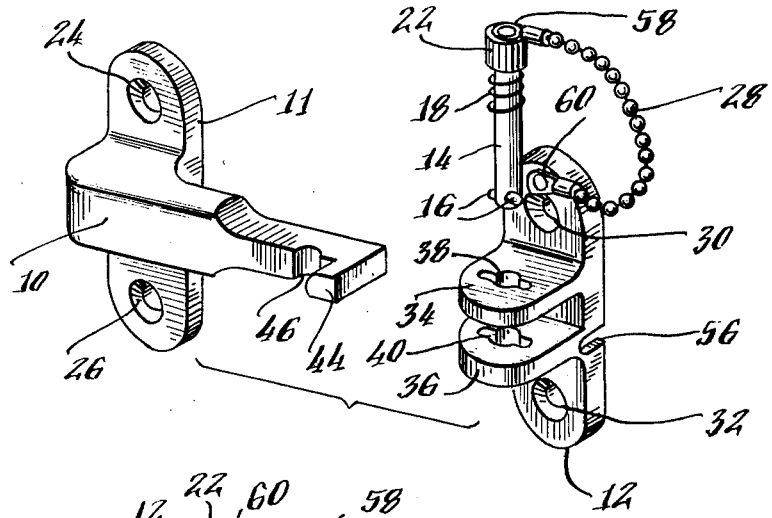
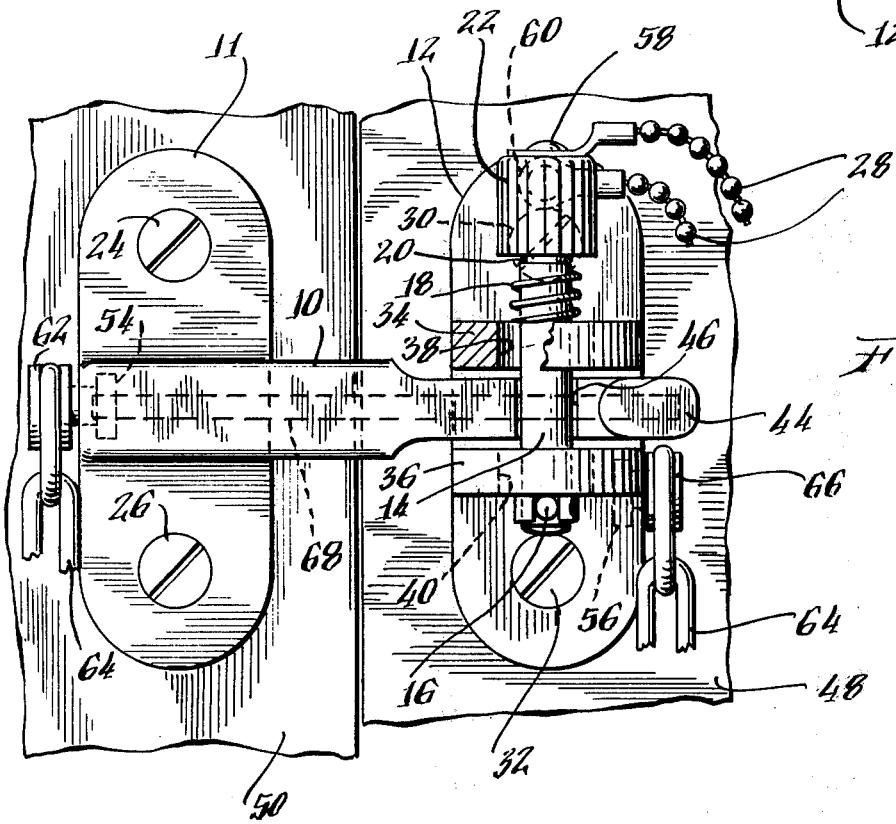
Fig. 2.
Fig. 3.
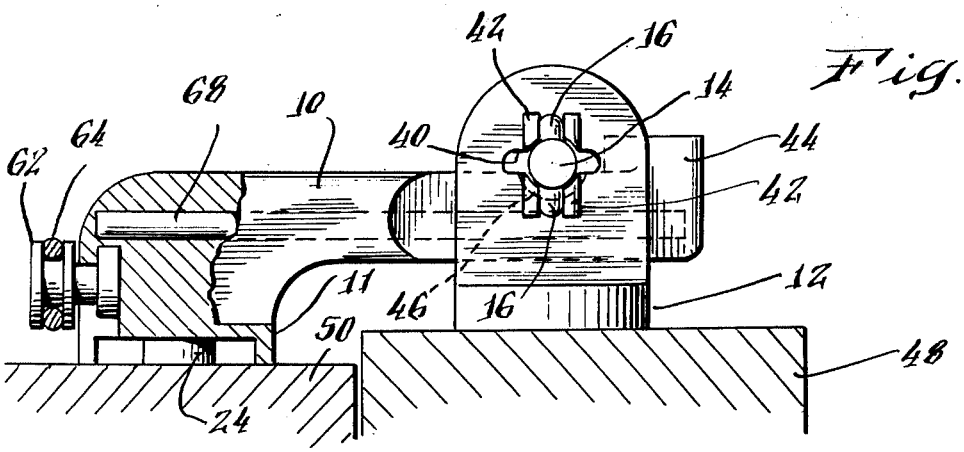

HIGH SECURITY DOOR LOCK

BACKGROUND OF THE INVENTION

1. Field of the Invention

The present invention relates to door locks. Conventional door locks are easily picked or sawed or allow the door to be jimmied, thus leaving the occupant vulnerable to thieves or other intruders who seek forceable entry. Picking is the act of inserting a thin piece of metal through the space between the door and door jamb and manipulating the lock until it is opened. It is desirable for the thief to be able to see the lock he is picking from the outside. Jimmying is the act of forcing a door open by prying it laterally with a crowbar or like implement. Sawing is performed by inserting a thin blade between the door and door jamb and sawing through the lock.

Specifically, the present invention relates to a high security, keyless door lock which is substantially pick-proof, saw resistant, tamper and jimmy proof. The door lock is attached to the door and the door frame. A horizontal crossbar is held in place by a pin which in turn is held in place by locking channels in a keeper. The lock is quickly and simply installed in an apartment, residence, business, or any other place where it is desired to secure a door from the inside.

2. Description of the Prior Art

Door locks of the crossbar type have been employed for many years and were even used in frontier times simply as a bar cross the gate of a fort. Over the years, various improvements have been made to crossbar locks. However, none of these improved crossbar locks appear to fully meet the needs of the modern urban dweller who, in these days of high crime, requires a strong lock which is substantially pick-proof, jimmy-proof, and saw resistant while at the same time being inexpensive, easy to install, and easy to open in the event of an emergency such as a fire.

An example of a prior art device including a crossbar type lock is shown in U.S. Pat. No. 1,351,117. Therein the crossbar type lock is used in combination with a conventional door lock with movement of the pin of the crossbar type lock being controlled by a pivotal cam device which is engaged by the lock bolt of the conventional door lock. When the conventional lock is closed, the lock bolt engages the cam device which in turn engages the pin end and projects it into an aperture to secure a horizontal member across the door to aid in inhibiting entry. When the lock bolt is opened, the cam device and therefore the pin drop due to gravity, freeing the horizontal member and allowing the door to open, thus, picking or jimmying of the conventional door lock will result in release of the crossbar type lock.

The use of pins as coupling means is well known in the art, see U.S. Pat. No. 299,083. Such coupling pins are employed, e.g., for the connection of a cutting bar of a harvester to its pitman. Exterior car door fasteners employing removable pins are also known for use in preventing sliding doors such as the doors of railroad cars from opening, see U. S. Pat. No. 1,165,013.

In using the pin constructions of U.S. Pat. Nos. 1,165,013 and 299,083, two hands are required to either couple or uncouple the devices thereby rendering them undesireable for possible use in a security door lock since ease of opening or closing of the lock from the inside is important to allow quick evacuation of the premises in the even of an emergency, such as a fire, and to enable the lock to be readily closed when one hand is occupied, for example, with a bag of groceries.

SUMMARY OF THE INVENTION

It is an object of the present invention to provide a high security interior door lock which overcomes the disadvantages of known interior door locks.

It is an object of this invention to provide a high security door lock that is substantially pick-proof.

Another object of this invention is to provide a high security door lock that is substantially jimmy-proof.

Another object of this invention is to provide a high security door lock that is simple to install.

Another object of this invention is to provide a high security door lock that when placed on the inside of a door is not visible from the outside.

Another object of this invention is to provide a high security door lock which is easily opened from inside a room with one hand to allow a quick escape in the event of a fire or other emergency.

Still another object of this invention is to provide a lock that can be readily closed with one hand.

Another object of this invention is to provide a high security door lock that is substantially saw-proof and tamper-proof.

Still another object of this invention is to provide a high security door lock which can be partially opened to view callers while still maintaining protection against forceable entry.

Other objects, aspects, and advantages of the present invention will be apparent from the detailed description and the accompanying drawings.

The present invention provides a high security door lock which is substantially pick-proof and jimmy-proof and which is easy to install and easy to open from the inside. The lock of this invention has a keeper member adapted to be mounted on a door frame, a crossbar adapted to be mounted on a door, and a pin for mechanically securing the crossbar to the keeper. The keeper includes at least one and preferably two spaced slotted apertures for receiving the pin having a projection means integrally formed therewith. A locking channel is integrally formed with the keeper member and oriented at an angle to the slotted aperture(s). The locking channel is arranged at an angle to the slotted aperture(s) such that the projection member registers therein on proper rotation of the pin. Biasing means coacts with the pin to provide an upward force on the pin during depression. The biasing means is preferably located remote from the locking channel and holds the projection means in the locking channel to prevent retraction of the pin absent depression and rotation of the projection means.

When the lock is attached to a door, the crossbar extends across the space between the door and the door frame or jamb and across the keeper member. When the lock is closed, the pin is projected through the slotted aperture(s) and depressed and rotated so that the projection member registers within the locking channel. Upon release of the downward force on the pin, the pin is held in the locking channel by the upward force exerted by the biasing means. Withdrawal of the pin and thus opening of the lock is prevented without depression and rotation of the pin.

The preferred embodiment of the present invention is illustrated in the drawings. However, it should be expressly understood that the present invention should not be limited solely to the illustrative embodiment. The drawings are as follows:

DESCRIPTION OF THE DRAWINGS

FIG. 1 is a perspective view of a high security door lock in accordance with the present invention;

FIG. 2 is a side elevational view of the high security door lock attached to a door and with the lock closed; and FIG. 3 is a bottom plan view showing of the lock of FIG. 2.

DETAILED DESCRIPTION OF THE INVENTION

This invention provides a high security door lock which has a crossbar secured to a keeper by a pin which is locked in place by a locking channel integral with the keeper for receiving projections or ears on the pin. A biasing member remote from the locking channel is provided which holds the pin in place absent depression and rotation of the pin. A projection is provided on the crossbar which prevents any horizontal sliding of the crossbar past the pin if the door is jimmied. The resulting door lock is easy to open from the inside, substantially jimmy and pick-proof. A hardened steel pin inserted in the crossbar provides saw resistance as well.

As shown in FIG. 1, a keeper 12 is provided for mounting on a door frame or jamb by placing screws through holes 30 and 32. The keeper 12 is in the form of a yoke having preferably a pair of spaced upper and lower elements 34 and 36 for reasons hereinafter explained. The spaced elements 34 and 36 include aligned apertures 38 and 40 which also have slots which are preferably aligned. As shown in FIG. 3, a locking channel 42 is provided integral with one of the elements, preferably the lower element 36, and oriented at an angle to the slot thereof. In the preferred embodiment, the locking channel 42 consists of two pairs of raised lugs, each pair of 180° to the other and located on the bottom of the lower element 36 and at an angle of 90° to the aligned slot in aperture 40.

A horizontal crossbar 10 for mounting to a door is also provided. In the preferred embodiment, the crossbar 10 is an elongate bar 10 with an integral vertical portion 11 at one end that has holes 24 and 26 to allow attachment of the crossbar to the door 50 by screws. The bar preferably has a saw-resistant inner member 68 made of hardened steel which extends the length of the crossbar 10. At the end of the crossbar remote from the attachment means is projection 44. Intermediate the projection 44 and the attachment means is a pin receiving notch 46.

A pin 14 having a pair of integrally formed projections or ears 16, preferably located adjacent its bottom end, secures the crossbar 10 to the keeper 12. The projections 16 are adapted to slide through the slotted apertures 38 and 40 of elements 34 and 36. The pin 14 also includes a biasing member 18 preferably in the form of a concentric spring. The biasing member 18 is preferably located intermediate the ears 16 and the enlarged knurled portion 22 of the pin 14. The pin 14 is preferably held within a groove or slot 20 formed in the pin 14 below the enlarged knurled portion 22. The spring 18 is mounted on the pin 14 by sliding the top of the spring into groove 20. Upon insertion of the pin 14 into the slotted apertures, the top of the spring bears against the enlarged knurled portion 22 and the bottom of the spring against the upper surface of the upper element 34 to apply an upward bias to the pin 14. The upper and lower elements 34 and 36 coact with the crossbar 10 to provide substantial jimmying resistance when the pin 14 is in its locking position. Although it is within the scope of the present invention to provide a slotted apertures having slots which are out of phase; it is preferred such slots be in phase to facilitate the opening and closing of the lock.

To operate the lock as best shown in FIG. 2, the door is closed, the crossbar 10 registers between the upper member 34 and lower member 36 of keeper 12 and behind the slotted apertures 38 and 40. The pin 14 is inserted into the keeper 12 by aligning the ears 16 with the slots in apertures 38 and 40. The pin 14 is then pushed down through slotted apertures 38 and 40. The pin 14 is then pushed down thrugh slotted apertures 38 and 40 and beyond the member 36 so that the ears 16 extend below the locking channel 42. By rotating the pin 90° and relieving the downward force on the pin 14, the ears 16 register in the channel 42 and are locked therein under the influence of the upward spring force thus preventing withdrawal absent depression and rotation of the pin. That is, the ears 16 are held in the channel 42 against member 36 by the upward pressure exerted by the spring 18 which bears against the enlarged knurled portion of the pin 22. The projection 44 on crossbar 10 cooperates with the pin 14 to prevent any possible jimmying of the door 50.

The security lock when closed proves a jimmy-proof, pick-proof, saw-proof lock. Advantageously, the pin 14 may be connected to the keeper member by a chain 28 connected e.g., to the top of the pin and to the top of the keeper 12. A recess 54 is provided the vertical portion 11 of the crossbar 10 to receive one end 62 of a chain 64. A recess 56 is provided on the remote side of keeper 12 and to receive the other end 66 of the chain 64. When the chain 64 is engaged in the recesses 54 and 56, the door may be partially opened while still preventing entry by an unwanted visitor.

Advantageously, the lock may be easily opened from the inside with one hand. To open the lock, the pin 14 is grasped at the enlarged knurled portion 22 and depressed so that the ears extend below the channel 42. While the pin is depressed, it is rotated 90° so the ears 16 align with the slots in apertures 38 and 40. The pin 14 is then drawn upward through slotted apertures 34 and 36, freeing the movement of the crossbar 10, thereby allowing the door to be opened.

It should be understood by those skilled in the art that various modifications may be made in the present invention without departing from the spirit and scope thereof, as described in the specification and defined in the appended claims.

What is claimed is:

1. A high security door lock comprising:

crossbar means adapted for mounting on a door;

keeper means adapted for mounting on a door frame;

pin means for mechanically coupling said crossbar means to said keeper means;

said pin means including projection means integrally formed therewith;

said keeper means including at least one slot for receiving said pin means and said projection means;

locking channel means integrally formed with said keeper means and oriented at an angle to said slot for receiving said projection means upon insertion of said projection means through said slot and rotation of said pin means; and biasing means coacting with said pin means for holding said projection means in said locking channel means and preventing coupling of said crossbar means for said crossbar means from said keeper means absent depression and rotation of said pin means.

2. A high security door lock as in claim 1 wherein said keeper means has upper and lower spaced members, each of said members having a slot for receiving said pin means.

3. A high security door lock as in claim 2 wherein said locking channel means is located on said lower member of said keeper means.

4. A high security door lock as in claim 2 wherein the crossbar has an outward projection thereon which coacts with said upper and lower spaced members and said pin means extending therebetween to inhibit jimmying.

5. A high security door lock as in claim 1 wherein the locking channel means includes a pair of spaced depending lugs.

6. A high security door lock as in claim 1 wherein the crossbar has a notch for receipt of said pin means.

7. A high security door lock as in claim 1 wherein said biasing means is located remote from said pin projection means.

8. A high security door lock as in claim 1 wherein the biasing means is a spring concentric with said pin means.

9. A high security door lock as in claim 1 including a safety chain, a slot in said keeper means and a slot in said crossbar for removably receiving said safety chain therein to allow partial opening of the door when said pin means is absent from said slot.

10. A high security door lock as in claim 1 wherein the crossbar includes saw resistant means along its length.

11. An improved door lock having a crossbar, a keeper having spaced members for receiving the crossbar therebetween and a pin, the spaced members having apertures for receiving said pin; the improvement comprising:

projection means integrally formed with said pin;

slots adjoining said apertures for enabling said projection means to pass therethrough upon receiving said pin;

said pin mechanically coupling the crossbar to the keeper;

locking channel means integral with one of said spaced members and at an angle to said slot in said spaced member, said locking channel means adapted to receive said projection means;

biasing means for holding said projection means in said locking channel to prevent uncoupling of the crossbar from the keeper absent depression and rotation of the pin.

12. A high security door lock comprising:

a crossbar means for mounting on a door;

a yoke shaped keeper means for mounting on a door frame;

said yoke shaped keeper means having upper and lower spaced members for receipt of said crossbar therebetween;

said uper and lower spaced members including apertures with slots in communication with said apertures;

a pin means for receipt in aid apertures to mechanically secure said crossbar means to said keeper means, said pin means including projection means for passage through said slots;

locking channel means integrally formed with one of said spaced members of said keeper means and oriented at an angle to said slot in said one spaced member for receiving said projection means upon rotation of said pin means after said projection means has passed through said aperture of said one spaced member;

an outward projection means integral with said crossbar means and located at the end remote from the door which in cooperation with the upper and lower members of the keeper means and said pin inhibits jimmying of the door; and biasing means coacting with said pin means for holding said projection means in said locking channel means to prevent withdrawal therefrom absent depression and rotation of said pin means.

13. A high security door lock as in claim 12 wherein said projection means is adjacent the lower end of said pin, and the locking channel means is located on said lower member of said keeper means.

14. A high security door lock as in claim 13 wherein the biasing means is concentric with the pin and remote from the pin projection means.

15. A high security door lock as in claim 14 wherein the biasing means is a spring for applying upward force on said pin means to hold said projection means in said locking channel means.

16. A high security door lock as in claim 15 wherein said pin means includes a groove for receiving one end of said spring.

17. a high security door lock as in claim 12 wherein the locking channel means is a pair of spaced depending lugs for receipt of said projection means.

18. A high security door lock as in claim 12 including a safety chain;

a slot in said crossbar means and a slot in said keeper means for removably receiving said safety chain for preventing full opening of the door when the pin is absent from said aperture.

19. A high security door lock as in claim 12 wherein the crossbar contains a hardened steel pin extending throughout its length.

* * * * *